US005854434A

United States Patent [19]

Saito et al.

[11] Patent Number: 5,854,434

[45] Date of Patent: Dec. 29, 1998

[54] HIGH-MODULUS IRON-BASED ALLOY WITH A DISPERSED BORIDE

[75] Inventors: Takashi Saito; Kouji Tanaka, both of Aichi, Japan

[73] Assignee: Kabushiki Kaisha Toyota Chuo Kenkyusho, Aichi-ken, Japan

[21] Appl. No.: 785,087

[22] Filed: Jan. 21, 1997

Related U.S. Application Data

[63] Continuation of Ser. No. 363,917, Dec. 27, 1994, abandoned.

[30] Foreign Application Priority Data

Dec. 27, 1993 [JP] Japan ..... 5-354467
Mar. 11, 1994 [JP] Japan ..... 6-067590

[51] Int. Cl.[6] ..... B22F 3/12; C22C 1/05; C22C 33/02

[52] U.S. Cl. ..... 75/244; 75/246; 419/12; 419/38

[58] Field of Search ..... 75/244, 246; 419/12, 419/38

[56] References Cited

U.S. PATENT DOCUMENTS

| | | | |
|---|---|---|---|
| 4,419,130 | 12/1983 | Slaughter | 75/244 |
| 4,439,236 | 3/1984 | Ray | 75/123 B |
| 4,505,746 | 3/1985 | Nakai | 75/243 |
| 4,966,626 | 10/1990 | Fujiki et al. | 75/238 |
| 4,971,624 | 11/1990 | Clark et al. | 75/238 |
| 5,036,028 | 7/1991 | Watanabe et al. | 501/96 |
| 5,059,490 | 10/1991 | Brupbacher et al. | 428/614 |
| 5,411,571 | 5/1995 | Kobayashi et al. | 75/232 |

FOREIGN PATENT DOCUMENTS 0 433 856 6/1991 European Pat. Off. .

OTHER PUBLICATIONS

13th International Plansee Seminar '93, Plansee Proceedings, vol. 2, pp. 44–66, May 24–28, 1993, T. Jungling, et al., "New Hardmetals Based On TIB2".

International Journal of Refractory & Hard Metals, vol. 7, No. 3, pp. 135–138, Sep. 1988, I. SMID, et al., "Evaluation of Binder Phases For Hardmetal Systems Based On TIB2".

Patent Abstracts of Japan, vol. 13, No. 372 (C–627), Aug. 17, 1989, and JP–A–1 127647, May 19, 1989.

Patent Abstracts of Japan, vol. 12, No. 33 (C–472), Jan. 30, 1988, and JP–A–62 182249, Aug. 10, 1987.

Patent Abstracts of Japan, vol. 12, No. 297 (C–519), Aug. 12, 1988, and JP–A–63 65056, Mar. 23, 1988.

Influence of Ferromagnetic Elastic Modulus Relaxation on the Determination of Magnetic Specific Heat of Fe, Ni, and Co. by Jack L. Lytton vol. 35 No. 8 pp. 2397–2406 Apr. 6, 1964.

Microstructure and Properties of a Rapidly Solidified Fe–Cr–Mo–B Alloy. by N. Saunders, et al. pp. 64–70, (1991).

Prediction of Young's Modulus of Particulate Two Phase Composites. by Zhongyun Fan, et al. Materials Science and Technology, Oct. 12, 1992 vol. 8. pp. 922–929.

*Primary Examiner*—Daniel J. Jenkins
*Attorney, Agent, or Firm*—Oblon, Spivak, McClelland, Maier & Neustadt, P.C.

[57] ABSTRACT

A high-modulus iron-based alloy containing at least one boride dispersed in an iron or iron-alloy matrix. The boride may be one of a Group IVa element, or a complex boride of at least one Group Va element and iron. A mixture of an iron or iron-alloy powder and a powder of at least one boride containing a Group IVa or Va element is compacted and sintered to make a shaped high-modulus iron-based alloy product.

19 Claims, 4 Drawing Sheets

HIGH-MODULUS IRON-BASED ALLOY WITH A DISPERSED BORIDE

This application is a Continuation of application Ser. No. 08/363,917, filed on Dec. 27, 1994, now abandoned.

BACKGROUND OF THE INVENTION

1. Field of the Invention

This invention relates to a high-modulus iron-based alloy and a process for manufacturing the same. More particularly, it relates to an iron-based alloy which has a high Young's or specific Young's modulus and is useful as a high-modulus structural metallic material, and a process for manufacturing the same.

2. Description of the Related Art

Steels or iron alloys are used more widely than any other structural metallic materials. The addition of an alloying element or elements to these metallic materials and the effective heat treatment thereof promote a very broad microstructural change and thereby provide the diversity in their mechanical properties, such as strength and toughness.

However, it has been regarded difficult to achieve a drastic improvement in the modulus despite of the importance in designing any structural part, since the modulus directly depends on the binding force of constituent atoms.

While there have not been reported many cases of research efforts made to improve the modulus of steel or an iron alloy, there has long been known a method which relies upon the texture of marked steel for high Young's modulus in a specific direction alone [see e.g. J. L. Lytton: J. of Applied Physics, 35–8(1964), 2397]. The application of the method is, however, limited only to thin sheet and not to any bulky material.

A great deal of research and development work has been made in the field of a composite material which comprises a matrix of a lightweight metal, such as a magnesium, aluminum or titanium alloy, and reinforcing fibers or particles employed for increasing the strength or modulus of the material. In fact, a composite material made by dispersing high-modulus particles in a lightweight metal matrix provides a high-modulus bulky material.

The above concept employed for improving the modulus of a lightweight alloy is, however, difficult to apply to steel or an iron alloy. Only some carbides and nitrides are in thermodynamic equilibrium with iron alloys, and no drastic improvement in Young's modulus can be expected in the dispersion of any such particles. It has been usual to precipitate carbides of molybdenum, vanadium, chromium, tungsten or the like in steels, particularly tool steels, for mainly improving their wear resistance. However, these carbides expressed by chemical formulas such as MC, M3C, M6C, M7C3 and M23C6, dissolve a large amount of iron and fail to contribute to any high Young's modulus of the alloys.

Some borides of transition elements show relatively high Young's modulus, but there has hardly been reported any result obtained by dispersing boride particles in an iron-alloy matrix to achieve an high-modulus iron-based alloy. As one of the few relevant cases, however, Miodownik, et al. report high-modulus iron-based alloy containing chromium and molybdenum boride particles [N. J. Saunders, L. M. Pan, K. Clay, C. Small and A. P. Miodownik: In User Aspects of Phase Diagrams, Inst. Materials, UK (1991), 64]. The iron-based alloy is processed by hot extrusion of rapidly solidified amorphous foil and subsequent heat treatment and is reported as having a Young's modulus in the vicinity of 25,000 kgf/mm$^2$.

There have also been proposed a high-modulus material containing not more than 20% by volume of high-modulus compound particles in an iron-based alloy matrix and a process for manufacturing it (Japanese Patent Application KOKAI No. 5-239504). According to the disclosure, high Young's modulus compound is introduced into a matrix by mechanical alloying, which results in a particle-dispersed iron-based alloy of high Young's modulus of at least 22,500 kgf/mm$^2$ and an impact value of at least 8 kgf-m/cm$^2$.

The particles in the high-modulus iron-based alloy proposed by Miodownik, et al. are, however, complex molybdenum-chromium-iron boride phase resulting from the reaction of boron with the iron-alloy matrix. Young's modulus of the complex boride is by far lower than that of a binary boride, i.e. chromium or molybdenum boride. The complex boride has a specific gravity of about 8.4 which is rather higher than that of the matrix. Therefore, the iron-based alloy containing the complex boride dispersed therein has an undesirably low specific Young's modulus. Moreover, the amorphous foil used is difficult to manufacture by existing facilities, since rapid cooling process is required in order to dissolve enormously high content boron into the foil.

The Japanese patent application referred to above discloses particles of a variety of compounds, such as carbides, borides and nitrides, but does not contain any disclosure at all as to the thermodynamic stability of those particles in the iron-alloy matrix. Although the carbides or nitrides of transition elements generally show high Young's modulus in themselves, their modulus is considerably lowered in an iron-alloy matrix, since the transition elements are partly substituted by iron atoms in the matrix. Therefore, it is impossible to achieve any high Young's modulus conforming to the law of mixture as disclosed by way of examples in the Japanese application. Even if those particles may retain their high Young's modulus in the matrix, it is hard to expect any conformity to the law of mixture. The modulus of a composite material usually varies with volume fraction of the particles along a curve stated theoretically in Materials Science and Technology, vol. 8 (1992), 922.

Incidentally, the dispersion of high Young's modulus particles, upon which both Miodownik et al. and the Japanese application rely for obtaining a high-modulus iron-based alloy was well known concept in the art of composite materials as hereinbefore described.

SUMMARY OF THE INVENTION

It is an object of this invention to provide an iron-based alloy which has a high Young's modulus and is useful as a high-modulus structural metal material. It is another object of this invention to provide a process useful for manufacturing any such alloy, and particularly, a structural part formed therefrom.

In view of the drawbacks of the prior art as hereinabove pointed out, we, the inventors of this invention focused on the importance of providing particles which are not only of high Young's modulus, but also thermodynamically stable in an iron alloy matrix. Because in case of unstable particles, the partial substitution of metal atoms by the iron atoms, or the formation of a complex iron compound leads to no product having satisfactorily high modulus, even if the particles may show high Young's modulus.

Within a variety of compounds which show high Young's modulus, we have found that borides of Group IVa elements are thermodynamically stable in an iron-alloy matrix. We have made an extensive metallographical study of a high-modulus iron-based alloy containing boride particles dispersed therein, and arrived at the high-modulus iron-based alloy of this invention.

We also cared that the conventional processes for steel parts could essentialy be applicable to manufacturing any such alloy as bulky material. So we have developed a novel process for manufacturing high-modulus iron-based alloys useful for the preparation of structural parts without using special technique or expensive facility.

Without relying upon any special technique or facility, but at a low cost. We considered that it was beneficial to utilize existing techniques or facilities by improving them. We have tried to realize an improved process which can manufacture any such alloy as a practically useful material ready for use in the preparation of a structural part, and arrived at the process of this invention. It is still another object of this invention to provide an iron-based alloy which has a high specific Young's modulus and is useful as a high-modulus structural metal material. It is a further object of this invention to provide a process which is useful for the practical manufacture of any such alloy, and particularly, a structural part formed therefrom.

The reaction of particles of many compounds with iron in an iron-alloy matrix results in a drastic reduction of their Young's modulus and the failure to yield any product having a satisfactorily high modulus, as stated before. Moreover, the complex borides were considered to have a Young's modulus which was by far lower than that of any binary boride, and a specific gravity which was higher than that of any iron alloy.

Under these circumstances, we have found that a boride containing a Group Va element and iron in an iron alloy react to form a complex boride of the Group Va element and iron having a high Young's modulus and a low specific gravity. More specifically, we have found that the complex boride which can realize a high Young's modulus, a low specific gravity and thereby a high specific Young's modulus is formed by the reaction of a boride of a Group Va element, or ferroboron, a ferroalloy containing a Group Va element and iron in an iron alloy. We have arrived at the high-modulus iron-based alloy of this invention as a result of out metallographical study of the optimum boride and matrix composition. We have also arrived at the process of this invention which can manufacture any such alloy at a low cost as a practically useful bulky material which is ready for use in the preparation of a structural part.

The high-modulus iron-based alloy of this invention comprises a matrix composed of iron or an iron alloy; and at least one boride selected from among borides of Group IVa elements and complex borides of one or more Group Va elements and iron, and dispersed in the matrix. It has a very high Young's modulus owing to the boride which is uniformly dispersed in the matrix.

The boride employed in the alloy of this invention provides excellent strengthening particles, as it has a high Young's modulus and is thermodynamically stable. The dispersion of its particles enables a high modulus than what has been available from any conventional product containing an equal volume fraction of particles. If the boride is a complex one having a specific gravity lower than that of the matrix, the iron-based alloy has a lower specific gravity and thereby a high specific Young's modulus.

The boride of a Group IVa element is a compound having an orderly crystal structure formed by strongly bound atoms, and has, therefore, a very high Young's modulus, since the binding force for its atoms has a direct bearing on its Young's modulus. It is thermodynamically stable in the matrix, and does not undergo any crystallographic change due to its reaction with the matrix, such as the substitution of its atoms by atoms of other elements, or the formation of any complex iron compound, but maintains its strong binding force and thereby its high Young's modulus in the matrix. Thus, the iron-based alloy of this invention has a very high Young's modulus.

The complex boride is also a compound having an orderly crystal structure formed by strongly bound atoms, and has, therefore, a very high Young's modulus. It is also thermodynamically stable in the matrix. Moreover, it has a specific gravity which is lower than that of the matrix. Thus, the iron-based alloy of this invention containing any such complex boride has a very high specific Young's modulus.

Other features and advantages of this invention will become apparent from the following description and the accompanying drawings.

DETAILED DESCRIPTION OF THE INVENTION

Figure 1:
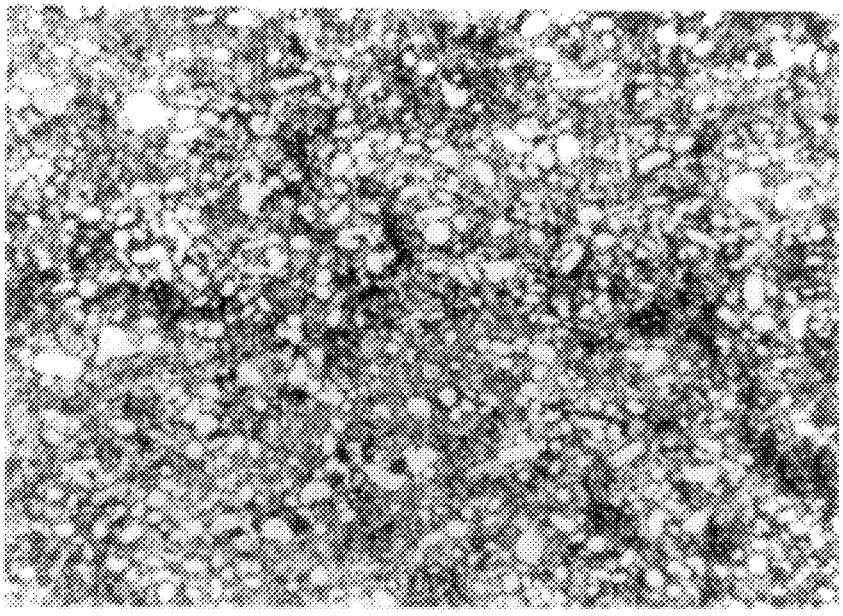
FIG. 1 is a photomicrograph of 600 magnifications showing the metallographic structure of a sintered iron-based alloy obtained in EXAMPLE 1 as will hereinafter be described.

According to a first aspect of this invention, there is provided a high-modulus iron-based alloy which comprises an iron or iron-alloy matrix, and at least one boride of Group IVa elements dispersed in the matrix. It offers a very high Young's modulus owing to the boride particles dispersed uniformly in the matrix. The boride having an ordered crystal structure of firmly bound atoms shows a very high Young's modulus. Moreover, the boride is in thermodynamic equilibrium with an iron-alloy matrix and do not undergo any crystallographic change due to the reaction with the matrix, such as the substitution by iron atoms in the matrix, or the formation of any complex iron compound. Therefore, the boride retains its high Young's modulus in the matrix and enables the iron-based alloy of this invention to exhibit very high Young's modulus.

The high-modulus iron-based alloy of this invention can be manufactured by a process which comprises the steps of mixing an iron, or iron-alloy powder and a powder of at least one boride of a Group IVa element to prepare a mixed powder, compacting the mixed powder into a shaped body, and sintering, in which at least one boride of IVa elements is dispersed in the iron. This process facilitates the manufacture of the alloy of this invention at a low cost.

The step of mixing the powders can be carried out by any known method without any special facility, or prior treatment. Any known method can be employed at orinary presure for compacting the mixed powder to form an appropriately shaped body with the strength enough for normal handling, since the mixed powder consists mainly of the iron, or iron-alloy powder with high compactibility.

Then, the compacted body is sintered. The sintering can be carried out in vacuum or inert gas atmosphere under the condition of ordinary temperature and time as for iron/steel sintered materials, which benefits high sinterability of the iron, or iron-alloy powder. The boride phase is in thermodynamic equiribrium with the matrix and remains uniformly dispersed particles even during sintering in a high temperature range. Thus, there is obtained a sintered product of an appropriate bulky shape having the intended microstructure as the high-modulus iron-based alloy containing at least one boride of a Group IVa element dispersed in the iron, or iron-alloy matrix.

The process which has been described can manufacture the high-modulus iron-based alloy at a low cost, since it is based on a common powder metallurgy process carried out by employing easily available powders of raw materials and existing facilities.

The high-modulus iron-based alloy according to the first aspect of this invention can also be manufactured by another process that comprises the steps of mixing an iron, or iron-alloy powder, a ferroboron powder and a ferroalloy powder containing at least one Group IVa element to prepare a mixed powder, compacting the mixed powder into an appropriately shaped body, and sintering it, the ferroboron and ferroalloy powders forming at least one boride of a Group IVa element dispersed in a matrix formed by the iron, or iron-alloy powder.

The powders which are employed by this process are less expensive than those employed by the process which has first been described. The ferroboron and ferroalloy powders react with each other to form the fine boride particles during the sintering step. Additionally, the ferroboron promotes the densification of a sintered product. Thus, this second process can manufacture the high-modulus iron-based alloy more easily at a lower cost. Otherwise, it shares the advantages with the first process. No repeated description is, therefore, made, but reference is made to the foregoing description of the mixing, compacting and sintering steps of the first process.

Description will now be made in further detail of the high-modulus iron-based alloy according to the first aspect of this invention and the process for manufacturing it.

There is a great deal of requirement for structural metallic materials providing higher modulus. Steels and iron alloys are not an exception, though they have the highest modulus of all the practically useful metallic materials and are used by far more often and widely for making structural members or parts than any other material. As for automobile engines, thinner or more slender parts of lighter inertia could meet the global demand for less fuel consumption. Designing of those parts, however, cannot be sufficiently extended because of the difficulty in ensuring necessary modulus rather than strength. In fact, it is believed that an improvement of, say, 20% in the modulus of any steel or iron-alloy part could cause the inovation of freedom in designing. Another demand for higher modulus materials is based on a requirement for less vibration, mainly concerned in automobile. The high-modulus iron-based alloy of this invention would hopefully satisfy all of these requirements, which have not been accomplished by any known steel or iron alloy, or particle-dispersed iron-based alloy. The alloy of this invention is, therefore, applicable to a wide variety of structural parts, including not only automobile engine parts or suspensions, but also various kinds of shafts, and parts for audio apparatus.

The dispersion of reinforcement in a matrix for improving its strength, modulus and wear resistance is well known in the art of the composite materials. In case of a metal matrix composite, some consolidation processes at high temperature are employed for composing reinforcement with a matrix as a bulky material. At the processing temperature, the interaction of co-existing phases inevitably occurs to cause a number of undesirable changes, including phase transformation of reinforcement and formation of brittle reacted layer along the interface. These changes usually impair the properties of the composite material to a far lower level than the theoretical one calculated in accordance with the law of mixture. We have, however, focused that the borides of Group IVa elements stay in thermodynamic equilibrium with iron alloys and can, therefore, be considered as the most effective particles to develop unexpectedly high modulus iron-based alloys At least one boride of the Group IVa element Ti (titanium), Zr (zirconium) or Hf (hafnium) is employed in the high-modulus iron-based alloy according to the first aspect of this invention. While any such boride having a Young's modulus of at least 25,000 kgf/mm$^2$ contributes to the improvement of the alloy, a diboride represented by chemical formula $MB_2$ (M: a Group IVa element) shows particularly high Young's modulus among others, and are preferred for the purpose of this invention. Any such diboride is a suitable material for the alloy of this invention, since the inherent or chemical stability promotes availability and easy handling.

The boride is preferably in the form of fine particles of a diameter below 100 microns, and homogeneously dispersed in the matrix. The boride particle having a particle diameter not exceeding 100 microns ensures that the alloy provide sufficiently high mechanical properties for practical use, including strength, toughness and ductility. Boride particles having a diameter not exceeding 20 microns are, however, more preferable, as they give an alloy having still higher levels of mechanical properties.

The alloy preferably has a boride content of 5 to 50% by volume with respect to the volume of the whole alloy to achieve satisfactorily high modulus. No alloy having a boride content below 5% by volume has satisfactorily high modulus, while any alloy having a boride content over 50% by volume is likely to have its mechanical properties degraded by the cohesion or coalescence of boride particles. A range of 10 to 40% by volume is particularly preferred.

Although a wide range of iron alloys, including ferritic, austenitic and martensitic ones, may be employed as the matrix, it is preferably formed from an iron alloy having a carbon content not exceeding 0.1% by weight to ensure that the boride exhibit such a high level of thermodynamic stability in the matrix without allowing formation of any carbide or boro-carbide, which leads to the failure of intended high-modulus.

While any process known in the art of steel or iron-alloy manufacture, such as casting, forging or powder metallurgy, can be employed for manufacturing the high-modulus iron-based alloy of this invention, powder metallurgy is, among others, preferred for the homogeneous dispersion of fine boride particles. An iron or iron-alloy powder and a powder of at least one boride of a Group IVa element are mixed to prepare a mixed powder. The mixed powder is compacted into an appropriately shaped body. The compacted body is sintered to produce a high-modulus iron-based alloy containing the boride particles dispersed in the iron or iron alloy matrix.

The iron or iron-alloy powder may be a commercially available one, or may be prepared by any known method. It is, thus, possible to use an inexpensive powder prepared by e.g. atomizing or electrolytic refining, such as a pure iron or stainless steel powder. While many commercially available powders are sieved below a particle diameter of, say, 150 microns (−#100), one having a particle diameter not exceeding 45 microns (−#330) facilitates the homogeneous dispersion of boride particles and the densification of a sintered product. Extremely fine powder having a particle diameter in the order of one micron or less is, however, undesirable, because of the difficulties in handling and compacting.

The boride powder may likewise be a commercially available one, or may be prepared by any known method. It preferably has a particle diameter of several microns. In case where only a powder of larger particle diameter is available, it is advisable to pulverize it to an appropriate particle size by e.g. a ball or vibration mill, or an attritor.

A V-blender, or a ball or vibration mill can, for example, be employed for mixing the powders. If the boride powder is cohesive form secondary particles, however, mixing in an attritor, or high energy ball mill is preferable employed to ensure the homogeneous dispersion of fine particles.

Any method, such as die, or cold isostatic pressing, may be employed for compacting the mixed powder into an appropriate shape. A compacting pressure of at least 2 tons/cm$^2$ is preferably employed to produce a sintered product having a satisfactorily high density.

The compacted body is preferably sintered in a vacuum, or in an inert gas atmosphere by employing a sintering temperature of 1000° C. to 1250° C. and a sintering time of about 1 to 4 hours. No product of satisfactorily high density can be obtained by less than 0.5 hour of sintering or at a temperature below 1000° C. No higher density can be expected from over four hours of sintering, but it is merely a waste of energy. No temperature over 1250° C. is appropriate, since the large amount of liquid phase resulting from the eutectic reaction causes the distortion of sintered product. It is recommended for still higher sintered density that the compacted body is preliminarily sintered at a temperature of 800° C. to 1000° C. for 0.5 to 1 hour, and that the preliminarily sintered product is compacted again before secondary sintering under the conditions as described above.

The foregoing description generally applies to also the process in which the ferroboron and ferroalloy powders are employed instead of the boride powder. While the ferroboron and ferroalloy powders are both commercially available as crushed products of ingots, it is advisable to employ products of composition close to intermetallic compounds because of the advantage in pulverizing with e.g. a ball or vibration mill, or an attritor. The proportions of the ferroboron and ferroalloy powders have to be so selected that the boride formed by their reaction may occupy an appropriate volume fraction. Milder conditions are available in the sintering, since ferroboron is reported to promote the densification effect in a sintered iron alloy.

In either event, the sintering step is preferably followed by hot working. The sintered density can easily be improved to its theoretically sufficient value by hot working, for example, forging, extrusion or swaging. The processing temperature is preferably at a temperature of 700° C. to 1250° C. While poor formability and enormously high stress are imposed below 700° C., and it is undesirably likely to form a liquid phase above 1250° C. Hot isostatic pressing is also effective for the densification of the sintered product. The process is preferably carried out under the conditions including temperature of 900° C. to 1200° C., a pressure of 500 to 2000 atm. and time of 1 to 10 hours, though the optimum conditions may vary with its reactivity with the atmosphere gas, the densification behavior and the economical factor.

According to a second aspect of this invention, there is provided a high-modulus iron-based alloy which comprises an iron or iron-alloy matrix and at least one complex boride of at least one Group Va element and iron dispersed in the matrix. This alloy also has a very high Young's modulus owing to not only the inherent high modulus of the complex boride, but also its thermodynamic stability. Moreover, it has a very high specific Young's modulus, since the complex boride with lower specific gravity than that of the matrix effectively lowers the specific gravity of the matrix as a whole.

The high-modulus iron-based alloy according to the second aspect of this invention can be manufactured easily at a low cost by employing either of the processes as hereinabove described in connection with the first aspect of this invention employing an appropriate boride or ferroalloy powder containing a Group Va element is employed.

The high-modulus iron-based alloys according to the second aspect of this invention contain at least one complex boride of at least one of the Group Va elements V (vanadium), Nb (niobium) and Ta (tantalum) and iron in the matrix. No report on the complex boride is a compound on which no report has hitherto been available, and of which even the basic physical properties are not well known. The density and Young's modulus can, however, be estimated to 6.1 to 6.9 and 40,000 kgf/mm$^2$, respectively, from the experimental results on the alloy of this invention as will be obvious from the description of examples.

The boride powder may be a commercially available one, or may be prepared by any known method. There are a number of types of borides as represented by chemical formulas $MB_2$, $M_3B_2$, $M_3B_4$, etc. (M: a Group Va element), and all of them can be used to form a complex boride having a high Young's modulus. The use of a diboride $MB_2$, among others, is, however, preferred, since the chemical stability promotes availability and easy handling.

The sintering step is preferably carried out at a temperature of 1000° C. to 1300° C. so as to last for, say, 1 to 4 hours. At any temperature above 1300° C., the large amount of liquid phase resulting from the eutectic reaction causes the distortion of the sintered product. The sintering step is preferably followed by hot working at a temperature of 700° C. to 1300° C. The sintered product is undesirably likely to form liquid phase above 1300° C.

No description in further detail is made of the manufacture of the alloy according to the second aspect of this invention, but reference is made to the description concerning the alloy according to the first aspect of this invention, since the same processes and conditions basically can be employed to both, unless otherwise noted.

The invention will now be described in further detail by way of examples.

EXAMPLE 1

A commercially available electrolytic iron powder (−#330) and a commercially available titanium diboride ($TiB_2$) powder having an average particle diameter of 4 microns were employed in amounts shown in Table 1, and mixed in an attritor having an argon gas atmosphere for 10 minutes to prepare a mixed powder. The mixed powder was compacted in a die at a pressure of 4 tons/$cm^2$ to form a solid cylindrical body having a diameter of 12.7 mm and a height of 12 mm. The compacted body was sintered at 1200° C. for an hour in a vacuum furnace. The sintered product was heated to 1200° C. in vacuum and then compressed to 75% reduction at a rate of 0.05 mm per second by a hot working simulator to obtain a higher density. Thus, there were prepared three disk-shaped samples having a diameter of about 25 mm (Samples Nos. 1 to 3).

FIG. 1 is a photomicrograph of 600 magnifications showing the metallographic structure of the sintered iron-based alloy obtained as Sample No. 2. As is obvious from FIG. 1, fine boride particles having a diameter of 1 to several microns in diameter are dispersed homogeneously uniformly in a pure iron matrix. The volume fraction of the boride particles in each sample is shown in Table 1. The local quantitative analysis by an electron probe microanalyzer indicated that the boride particles contained 1.5% of iron, 69.1% of titanium and 29.3% of boron, all on a weight basis. As is obvious from these figures, the boride lettle dissolves the iron from the matrix, which is consistent with the result of X-ray diffraction characterizing titanium diboride. These results show that the titanium diboride employed in the mixed powder remained thermodynamically stable in the iron matrix without undergoing any change in crystal structure or any notable compositional change at the high temperature employed for sintering and hot working.

EXAMPLE 2

Three disk-shaped samples of iron-based alloys similar in size to EXAMPLE 1 (Samples Nos. 4 to 6) were prepared by employing a commercially available Fe-17Cr powder (–#330) and a commercially available $TiB_2$ powder similar in size to EXAMPLE 1, and repeating the mixing, compacting, sintering anf hot working steps of EXAMPLE 1.

Figure 2:
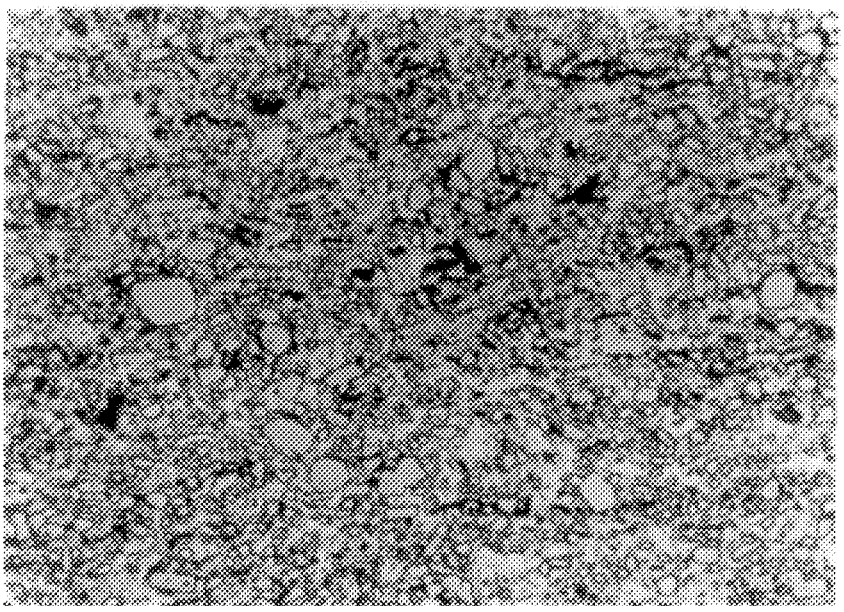
FIG. 2 is a photograph similar to FIG. 1, but showing the structure of a product obtained in EXAMPLE 2.

FIG. 2 is a photomicrograph of 600 magnifications showing the metallographic structure of Sample No. 5. As is obvious from FIG. 2, fine boride particles having a diameter of 1 to several microns in diameter are dispersed homogeneously in a ferritic Fe-17Cr alloy matrix. The volume fraction of the boride in each sample is shown in Table 1. The local quantitative analysis by an electron probe microanalyzer indicated that the boride particles contained contained 1.0% of iron, 0.2% of chromium, 69.0% of titanium and 29.7% of boron, all on a weight basis. As is obvious from these figures, the boride little dissolves the iron and chromium from the matrix, which is consistent with the result by X-ray diffraction characterizing titanium diboride. These results teach that the titanium diboride particles in the mixed powder remained thermodynalically stable in the iron alloy without undergoing any change in crystal structure or any notable change in composition at the high temperature employed for sintering and hot working.

Young's modulus of the iron-based alloys obtained in EXAMPLES 1 and 2 were evaluated for their Young's modulus. A testpiece in the form of a rectangular column measuring 1 mm by 2 mm by 11.2 mm was cut from each Sample, and examined for its Young's modulus by a piezoelectric resonance method employing a quartz resonator. The results are shown in Table 1. As is obvious from Table 1, the Young's modulus generally showed an improvement with an increase in the volume fraction of the titanium diboride particles, and reached a maximum of about 29,000 kgf/$mm^2$ as shown by the sample containing about 30% by volume of boride. This is an improvement of 40% or more over the Young's modulus of any conventional iron alloy, and an improvement of 70% or more over the specific Young's modulus. Since titanium diboride has a density which is by far lower than that of an iron alloy, the iron-based alloy in which it is dispersed has a lower density with increasing volume fraction of titanium diboride. It, therefore, follows that the high-modulus iron-based alloy of this invention provides a dimensional for lighter inertia of any structural part enhanced with its low specific gravity.

EXAMPLE 3

A disk-shaped sample of a sintered iron-based alloy similar in size to the foregoing Examples (Sample No. 7) was prepared by employing a commercially available Fe-17Cr powder (–#330), a commercially available $TiB_2$ powder similar in size to the foregoing Examples and graphite powder, and repeating the mixing, compacting, sintering and hot working steps of EXAMPLE 1. Its Young's modulus was determined by the method employed in EXAMPLES 1 and 2, and is shown in Table 1. As is obvious from Table 1, Sample No. 7 showed an improvement of about 20% in Young's modulus over any conventional iron alloy. Due to the presence of carbon, however, its Young's modulus was about 7.3% lower than that of Sample No. 5 in EXAMPLE 2, despite the fact that the same fraction of titanium diboride particles had been dispersed in both Samples.

Comparative Example 1

A comparative disk-shaped sample of sintered iron similar in size to the foregoing Examples (Sample No. C1) was prepared by employing a commercially available electrolytic iron powder (–#330) alone, and repeating the mixing, compacting, sintering and hot working steps of EXAMPLE 1. The Young's modulus was determined by the method employed in EXAMPLE 2, and is shown in Table 1. It was as low as 18,910 kgf/$mm^2$.

Comparative Example 2

A comparative disk-shaped sample of a sintered iron alloy similar in size to the foregoing Examples (Sample No. C2) was prepared by employing a commercially available Fe-17Cr powder (–#330) alone and repeating the mixing, compacting, sintering and hot working steps of EXAMPLE 1. The Young's modulus was determined by the method employed in EXAMPLE 2, and is shown in Table 1. It was as low as 20,250 kgf/$mm^2$.

Comparative Example 3

Figure 3:
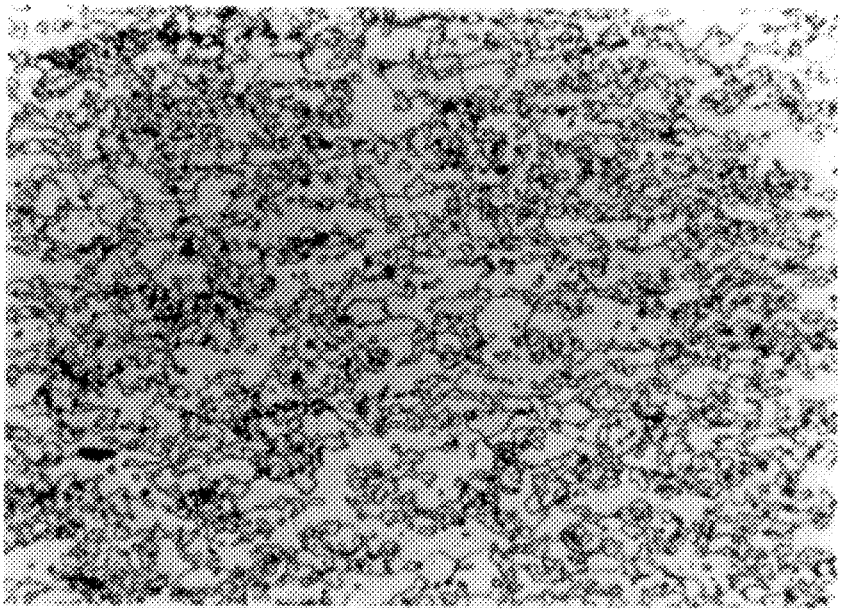
FIG. 3 is a photograph similar to FIG. 1, but showing the structure of a product obtained in COMPARATIVE EXAMPLE 3.

A comparative disk-shaped sample of a sintered iron-based alloy similar in size to the foregoing Examples (Sample No. C3) was prepared by employing commercial F-17Cr powder (–#330) and commercial MoB powder having an average particle diameter of 1.7 microns, and repeating the mixing, compacting, sintering and hot working steps of EXAMPLE 1. FIG. 3 is a photomicrograph of 600 magnifications showing the metallographic structure of Sample No. C3. As is obvious from FIG. 3, fine boride particles having a diameter of several microns and dispersed in a ferritic Fe-17Cr matrix. Table 1 shows the volume fraction of the boride particles as measured from Sample No. C3. The local analysis of the boride by an electron probe microanalyzer indicated that it contained 19.0% of iron, 3.8% of chromium, 69.3% of molybdenum and 8.2% of boron, all on a weight basis. Thus, the boride particles were found to contain a large amount of iron, which was main constituent of the matrix, and some chromium, too. The X-ray diffraction revealed that the boride was a complex boride of iron, chromium and molybdenum represented by chemical formula $Mo_2(Fe,Cr)B_2$. Thus, it was found that molybdenum boride in the mixed powder could not be in thermodynamic equilibrium with the iron alloy matrix and was useless for the purpose of this invention. The Young's modulus of Sample No. C3 was determined by the method employed in EXAMPLE 2, and is shown in Table 1. Although Sample No. C3 showed an improved Young's modulus owing to the presence of the boride over Sample No. C2, it was as low as 24,580 kgf/mm$^2$ despite the presence of as much as 26.2% by volume of the boride.

Comparative Example 4

A comparative disk-shaped sample of a sintered iron-based alloy similar in size to the foregoing Examples (Sample No. C4) was prepared by employing a commercially available Fe-17Cr powder (–#330) and a TiC powder having an average particle diameter of 2 microns, and repeating the mixing, compacting. sintering and hot working steps of EXAMPLE 1. The volume fraction of the carbide particles as measured from Sample No. C4 is shown in Table 1. The local analysis of the carbide particles by an electron probe microanalyzer indicated that they contained 10.4% of iron, 2.3% of chromium, 71.3% of titanium and 16.0% of carbon, all on a weight basis. Thus, the carbide particles were found to contain a large amount of iron, which was main constituent of the matrix, and some chromium, too. These results revealed the substantial substitution of iron for titanium atoms in the carbide. It follows that titanium carbide in the iron alloy matrix lacked thermodynamical stability and was useless for the purpose of this invention. The Young's modulus of Sample No. C4 was determined by the method employed in EXAMPLE 2, and is shown in Table 1. Although Sample No. C4 showed an improved Young's modulus owing to the carbide, it was as low as 25,330 kgf/mm$^2$ despite the presence of as much as 33.5% by volume of carbide.

Figure 4:
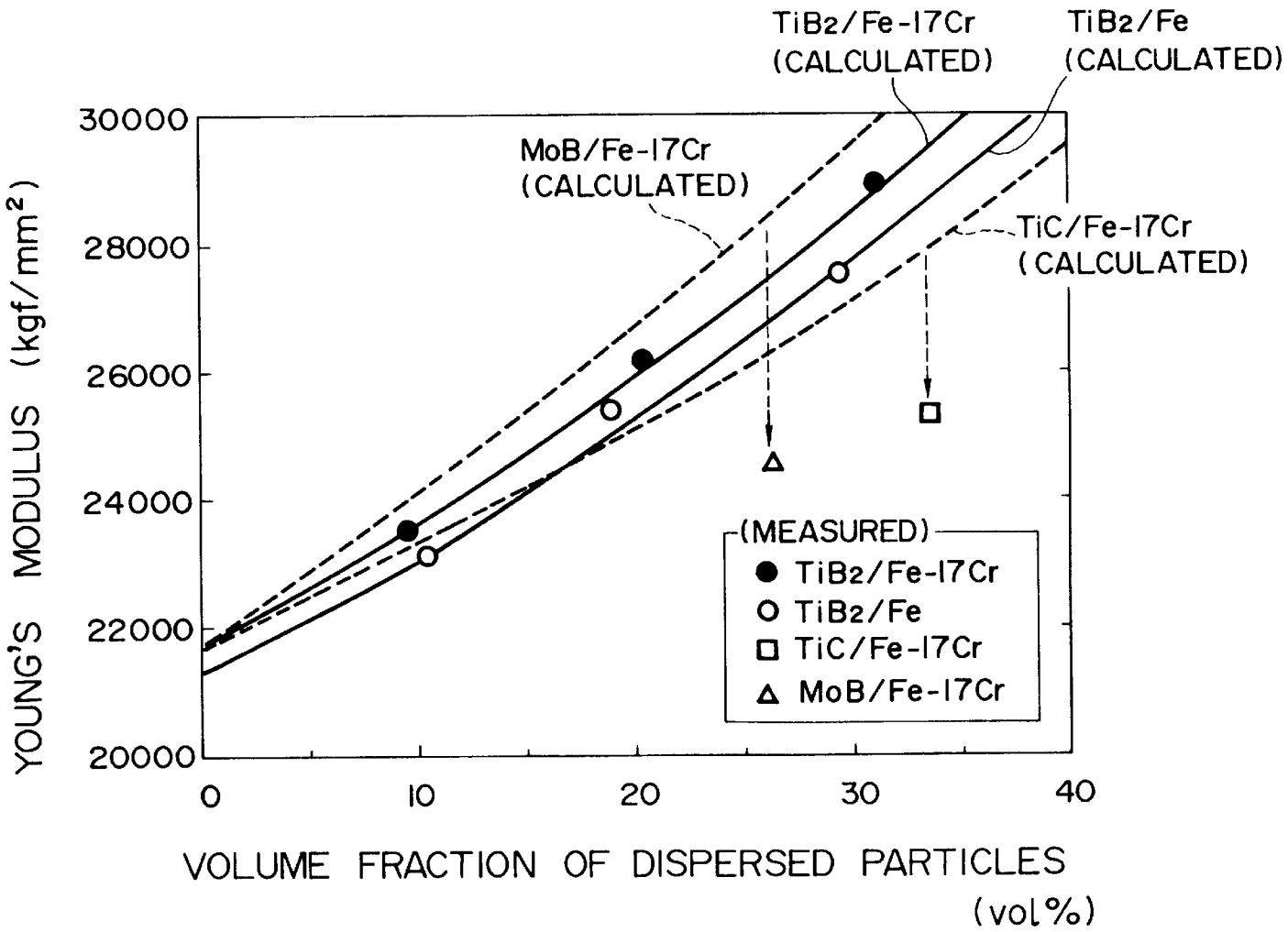
FIG. 4 is a graph comparing the values of Young's modulus as measured and calculated of the sintered iron-based alloys obtained in EXAMPLES 1 and 2 of this invention and COMPARATIVE EXAMPLES 3 and 4.

FIG. 4 compares the measured Young's moduli of the iron-based alloys according to EXAMPLES 1 and 2 and COMPARATIVE EXAMPLES 3 and 4 plotted against the volume fraction of the boride or carbide in each alloy, and the corresponding values obtained by calculation from the theoretical formula for the Young's moduli of the composite materials which is described in Materials Science and Technology, vol. 8 (1992), 922. As is obvious from FIG. 4, the alloys according to EXAMPLES 1 and 2 containing titanium diboride showed the Young's moduli which substantially coincided with the calculated values, and it was confirmed that titanium diboride provided excellent reinforcing phases imparting a theoretically high modulus to the iron alloy. On the other hand, the Young's modulus of the product of COMPARATIVE EXAMPLE 3 containing molybdenum boride was by far lower than the calculated value. This was due to the fact that the molybdenum boride had transformed to a complex boride of iron, chromium and molybdenum with lower Young's modulus, as is obvious from the foregoing discussion. The Young's modulus of the product of COMPARATIVE EXAMPLE 4 containing carbide was also by far lower than the calculated value. This was apparently due to a substantial substitution of iron for titanium atoms in the titanium carbide resulting in a reduction of Young's modulus, as is obvious from the foregoing discussion.

EXAMPLE 4

A commercially available Fe-17Cr powder (–#330) and a commercially available $VB_2$ powder having an average particle diameter of 2 microns were employed in the amounts shown in Table 2, undergoing the mixing, compacting, sintering and hot working steps as in EXAMPLE 1, and formed into two disk-shaped samples similar in size to those of the foregoing Examples (Sample Nos. 8 and 9).

Figure 5:
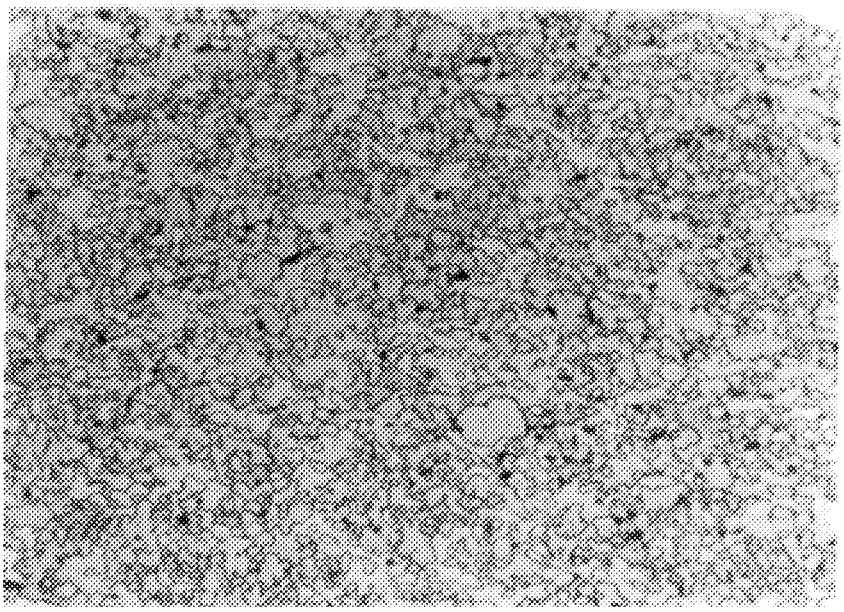
FIG. 5 is a photograph similar to FIG. 1, but showing the structure of a product obtained in EXAMPLE 4.

FIG. 5 is a photomicrograph of 600 magnifications showing the metallographic structure of the sintered iron-based alloy obtained as Sample No. 9. As is obvious from FIG. 5, fine complex boride particles of several microns, in diameter are dispersed homogeneously in a ferritic Fe-17Cr matrix. The volume fraction and density of the boride particles in each Sample were measured, and are shown in Table 2. The local analysis by an electron probe microanalyzer indicated that the boride particles contained 35.9% of vanadium and 30.0% of iron, 22.2% of chromium and 12.0% of boron, all on a weight basis. It is obvious that the vanadium diboride in the mixed powder reacted with iron in the matrix at the high sintering and hot working temperature to form the complex boride.

The samples were examined for density and Young's modulus by the same method as employed in EXAMPLE 2. The results are shown in Table 2. As is obvious from Table 2, Sample Nos. 8 and 9 having boride volume fraction of the boride particles of 17% and 31%, respectively, showed relatively high Young's modulus in the order of 23,900 kgf/mm$^2$, 26,500 kgf/mm$^2$, which are emprovements of about 20% and 30%, respectively, over the Young's modulus of any conventional iron alloy. The density of the Samples decreased with increasing volume fraction of boride particles. It, therefore, follows that the complex boride had a lower specific gravity than that of the iron-alloy matrix.

EXAMPLE 5

A disk-shaped sample of a sintered iron-based alloy similar in size to the foregoing Examples (Sample No. 10) was prepared by employing a commercially available Fe-17Cr powder (–#330), a commercially available $VB_2$ powder having an average particle diameter of two microns and a commercially available graphite powder, and repeating the mixing, compacting, sintering and hot working steps of EXAMPLE 1. The volume fraction of the boride particles in the sample and its density and Young's modulus were determined by employing the methods employed in EXAMPLES 1 and 2. The results are shown in Table 2. As is obvious from Table 2, Sample No. 10 showed an improvement of about 20% in Young's modulus over the conventional iron alloy. Due to the presence of carbon, its Young's modulus was, however, about 7.9% lower due to the presence of carbon than that of Sample No. 9 (EXAMPLE 4), despite the fact that same fraction of comples boride had been dispersed in both of Samples.

EXAMPLE 6

Two disk-shaped samples of sintered iron-based alloys each similar in size to the foregoing Examples (Samples Nos. 11 and 12) were prepared by employing a commercially available Fe-17Cr powder (–#330) and a commercially available $NbB_2$ powder having an average particle diameter of two microns, and repeating the mixing, compacting, sintering and hot working steps of EXAMPLE 4.

The microscopic examination of each sample for its metallographic structure confirmed that it contained fine boride particles of several microns in diameter are dispersed homogeniously in a ferritic Fe-17Cr matrix. The local analysis by an electron probe microanalyzer indicated that the boride particles contained 51.6 % of niobium and 34.9 % of iron, 4.0% of chromium and 9.5% of boron all on a weight basis. Thus, it is obvious that the niobium diboride, in the mixed powder, reacted with iron in the matrix at the high sintering and hot working temperature to form the complex boride.

The volume fraction of the complex boride particles in each sample and its density and Young's modulus were determined by the methods employed in EXAMPLE 2. The results are shown in Table 2. As is obvious from Table 2, Sample Nos. 11 and 12, having boride volume showed relatively high Young's modulus. The density of the samples decreased with increasing volume fraction of boride particles. thus it follows that the complex boride had a lower specific density than that of the iron-alloy matrix.

Figure 6:
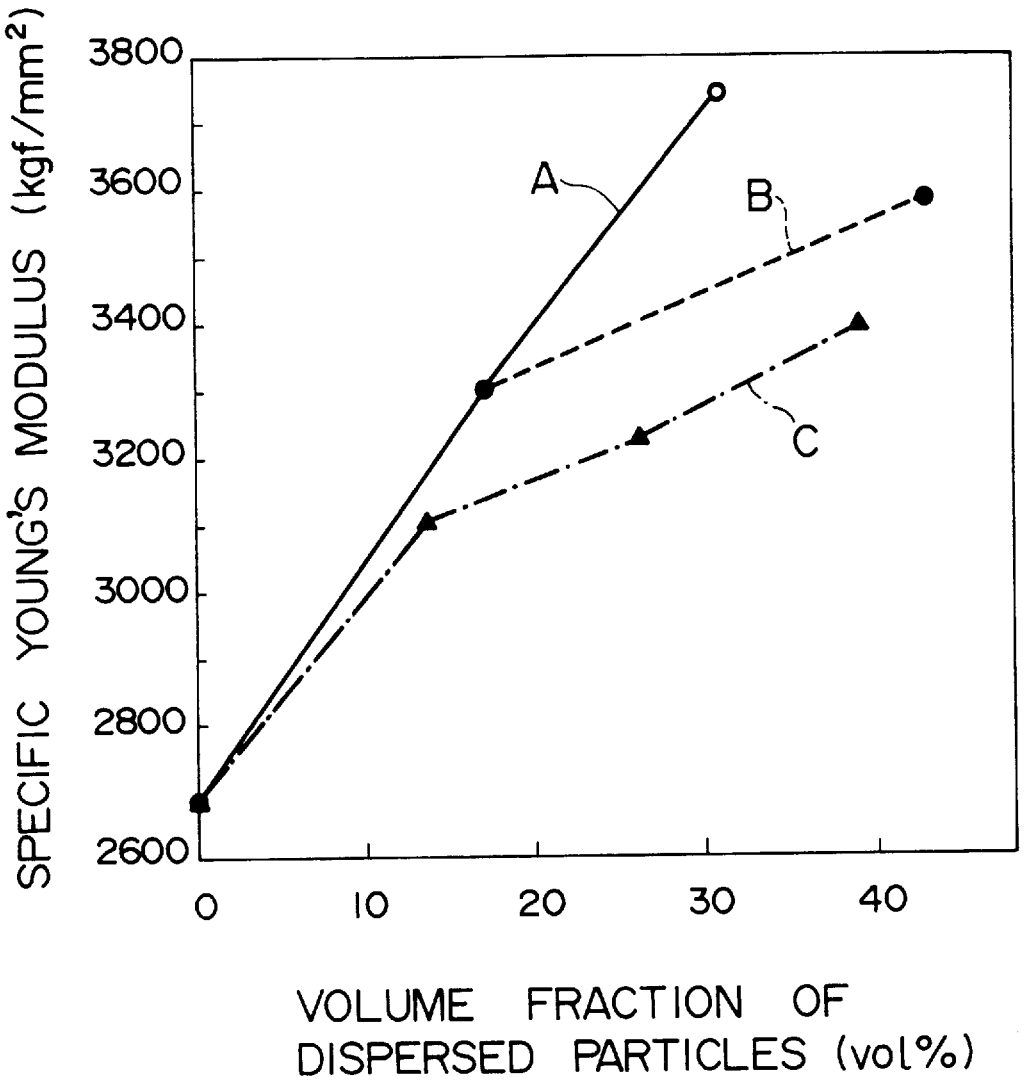
FIG. 6 is a graph comparing in specific Young's modulus the sintered iron-based alloys obtained in EXAMPLES 4 and 6 of this invention and COMPARATIVE EXAMPLE 3.

FIG. 6 shows the specific Young's modulus of each of the products of EXAMPLES 4 and 6 and COMPARATIVE EXAMPLE 3 in relation to its volume fraction of boride. The specific Young's modulus of each product was obtained by dividing its Young's modulus by its specific gravity. In FIG. 6, curves A, B and C show the specific Young's moduli of the product of EXAMPLE 4 containing complex boride particles of vanadium and iron, the product of EXAMPLE 6 containing a complex boride of niobium and iron, and the product of COMPARATIVE EXAMPLE 3 containing a complex boride of molybdenum and iron, respectively.

As is obvious from FIG. 6, the products of this invention showed higher specific Young's modulus owing to their lower specific gravity, even when compared with the comparative iron-based alloy containing an equal amount of boride particles. These results confirm that the high-modulus iron-based alloys of this invention enable a further contribution to lighter inertia of smaller and thinner structural parts owing to their low specific gravity.

EXAMPLE 7

Three disk-shaped samples of sintered iron-based alloys each similar in size to the foregoing Examples (Samples Nos. 13 to 15) were prepared by employing a pulverized ferrotitanium powder and a pulverized ferroboron powder, both having an average particle diameter of four microns, as well as a commercially available Fe-17Cr powder (–#330) in the amounts shown in Table 3, and repeating the mixing, compacting, sintering and hot working steps of EXAMPLE 1.

The volume fraction of precipitated particles in each sample was measured, and is shown in Table 3. The local analysis by an electron probe microanalyzer indicated that the particles contained 0.9% of iron, 68.5% of titanium and 30.4% of boron, all on a weight basis. As is obvious from these figures, together with the results of X-ray diffraction, the formation of titanium diboride with little iron was confirmed. It is, thus, obvious that the ferrotitanium and ferroboron particles react at the high sintering and hot working temperature to form the titanium diboride particles which are thermodynamically stable in the iron-alloy matrix.

The Young's modulus of each sample was determined by employing the method employed in EXAMPLE 2, and is shown in Table 3. As is obvious from Table 3, the samples showed Young's modulus increased with increasing volume fraction of boride particles, including Sample No. 15 containing about 30% by volume showing a Young's modulus as high as 29,500 kgf/mm$^2$ These are comparable in Young's modulus to the products of EXAMPLE 2 produced with titanium diboride powder. These results confirm that the use of ferrotitanium and ferroboron powders as the starting materials is also effective for manufacturing high-modulus iron-based alloy in which titanium diboride particles are dispersed.

TABLE 1

| | Amounts of materials mixed (g) | | | Alloy | Volume | |
|---|---|---|---|---|---|---|
| Sample No. | Fe powder Fe-17Cr powder | Boride Powder | Graphite powder | composition (wt. %) | fraction (vol. %) | Young's modulus |
| Example of the Invention | | | | | | |
| 1 | 94.0 | 6.0 | — | Fe-4.3Ti-1.9B | 10.4 | 23,120 |
| 2 | 87.4 | 12.6 | — | Fr-9.1Ti-4.0B | 18.9 | 25,390 |
| 3 | 80.2 | 19.8 | — | Fe-14.1Ti-6.3B | 29.4 | 27,530 |
| 4 | 93.8 | 6.2 | — | Fe-17Cr-4.3Ti-1.9B | 9.5 | 23,520 |
| 5 | 87.0 | 13.0 | — | Fe17Cr-9.1Ti-4.0B | 20.4 | 26,190 |
| 6 | 79.6 | 20.4 | — | Fe-17Cr-14.1Ti-6.3B | 31.1 | 28,950 |
| 7 | 86.6 | 13.0 | 0.4 | Fe-17Cr-9.4Ti-4.1B-0.4C | 20.9 | 24,280 |
| Comparative Example | | | | | | |
| C1 | 100.0 | — | — | Fe | — | 18,910 |
| C2 | 100.0 | — | — | Fe-17Cr | — | 20,250 |
| C3 | 77.8 | 22.2 | — | Fe-17Cr-19.9Mo-2.3B | 26.2 | 24,580 |
| C4 | 78.3 | 21.7 | — | Fe-17Cr-17.4Ti-4.4C | 33.5 | 25,330 |

TABLE 2

| Sample No. | Amounts of powders mixed (g) Iron alloy | Boride | Other | Alloy composition (wt. %) | Volume fraction (vol. %) | Young's modulus | Specific gravity |
|---|---|---|---|---|---|---|---|
| Example of the Invention | | | | | | | |
| 8 | 93.1 | 6.9 | — | Fe-17Cr-4.8V-2.1B | 17.0 | 23,940 | 7.25 |
| 9 | 85.7 | 14.3 | — | Fe-17Cr-10.0V-4.3B | 31.0 | 26,530 | 7.08 |
| 10 | 85.7 | 14.3 | 0.4 | Fe-17Cr-9.9V-4.22B-0.4C | 30.4 | 24,440 | 7.01 |
| 11 | 90.7 | 9.3 | — | Fe-17Cr-7.5Nb-1.8B | 17.0 | 24,460 | 7.40 |
| 12 | 81.3 | 18.7 | — | Fe-17Cr-15.2Nb-3.5B | 43.0 | 26,120 | 7.28 |
| Comparative Example | | | | | | | |
| C5 | 100.0 | — | — | Fe-17Cr | — | 20,250 | 7.54 |
| C6 | 77.8 | 22.2 | — | Fe-17Cr-19.9Mo-2.3B | 26.2 | 24,580 | 7.60 |

TABLE 3

| Sample No. | Amounts of materials mixed (g) Fe-17Cr powder | Ferrotitanium powder | Ferroboron powder | Alloy composition (wt. %) | Volume fraction (vol. %) | Young's modulus ($kgf/mm^2$) |
|---|---|---|---|---|---|---|
| Example of the Invention | | | | | | |
| 13 | 81.3 | 9.8 | 8.9 | Fe-14.7Cr-4.3Ti-1.9B | 12.5 | 23,910 |
| 14 | 61.0 | 20.5 | 18.5 | Fe-11.9Cr-9.1Ti-4.0B | 21.1 | 26,420 |
| 15 | 38.8 | 32.1 | 29.1 | Fe-8.3Cr-14.1Ti-6.3B | 31.3 | 29.580 |

What is claimed is:

1. An iron-based alloy consisting essentially of:

a matrix formed of iron or an iron alloy; and at least one boride selected from the group consisting of borides of Group IVa elements titanium, zirconium or hafnium and complex borides of at least one Group Va element vanadium, niobium or tantalum, and iron, said at least one boride being dispersed in said matrix, and wherein said at least one boride is in the form of fine particles having a diameter of not more than 100 microns, and dispersed uniformly in said matrix.

2. A iron-based alloy as set forth in claim 1, wherein said iron-based alloy has a content of carbon of not more than 0.1% by weight.

3. An iron-based alloy as set forth in claim 1, wherein the content of said at least one boride is from 5 to 50% by volume.

4. An iron-based alloy as set forth in claim 3, wherein the content of said at least one boride is from 10 to 40% of volume.

5. An iron-based alloy as set forth in claim 1, wherein said fine particles have a diameter of not more than 20 microns.

6. An iron-based alloy as set forth in claim 1, wherein said at least one boride of said borides of Group IVa elements is a diboride represented by chemical formula $MB_2$, where M stands for Group IVa elements.

7. An iron-based alloy as set forth in claim 1, wherein said at least one boride is a boride of the Group IVa elements.

8. An iron-based alloy as set forth in claims 1, wherein said at least one boride is a complex boride of at least one Group Va element and iron.

9. An iron-based alloy as set forth in claim 1, wherein said at least one boride is in the form of fine particles having an average diameter of 4 to 100 microns.

10. An iron-based alloy as set forth in claim 1, wherein said iron-based alloy has a content of carbon of not more than 0.1% by weight, the content of said at least one boride is from 5 to 50% by volume, and said at least one boride is in the form of fine particles having an average diameter of 4 to 100 microns.

11. A process for manufacturing a high-modulus iron-based alloy according to claim 1, comprising the steps of:

mixing iron or iron-alloy powders and powders of at least one boride of Group IVa elements titanium, zirconium or hafnium to prepare mixed powders;

compacting said mixed powders into a shaped body; and sintering said shaped body, thereby dispersing particles of said at least one boride of said Group IVa elements in a matrix formed of said iron or iron-alloy powders.

12. A process as set forth in claim 11, further comprising hot working after said sintering.

13. A process for manufacturing a high-modulus iron-based alloy according to claim 1, comprising the steps of:

mixing iron or iron-alloy powders, ferroboron powders, and ferroalloy powders containing at least one Group IVa element titanium, zirconium or hafnium to prepare mixed powders;

compacting said mixed powders into a shaped body; and sintering said shaped body, thereby causing reaction of said ferroboron powders and said ferroalloy powders to form at least one boride of said Group IVa elements and to disperse particles thereof in a matrix formed of said iron or iron-alloy powders.

14. A process as set forth in claim 13, further comprising hot working after said sintering.

15. A process for manufacturing a high-modulus iron-based alloy according to claim 1, comprising the steps of:

mixing iron or iron-alloy powders and powders of at least one boride of Group Va elements vanadium, niobium or tantalum to prepare mixed powders;

compacting said mixed powders into a shaped body; and sintering said shaped body, thereby dispersing particles of at least one complex boride of said iron or iron-alloy powders.

16. A process as set forth in claim 15, further comprising hot working after said sintering.

17. A process for manufacturing a high-modulus iron-based alloy according to claim 1, comprising the steps of:

mixing iron or iron-alloy powders, ferroboron powders, and ferroalloy powders containing at least one Group Va element vanadium, niobium or tantalum to prepare mixed powders;

compacting said mixed powders into a shaped body; and sintering said shaped body, thereby causing reaction of said ferroboron powders and said ferroalloy powders to form at least one complex boride of at least one Group Va element and iron and to disperse particles thereof in a matrix formed of said iron or iron-alloy powders.

18. A process as set forth in claim 17, further comprising hot working after said sintering.

19. An iron-based alloy comprising:

(a) a matrix comprising iron or an iron alloy; and (b) at least one compound selected from the group consisting of (i) borides of Group IVa elements and (ii) complex borides of at least one Group Va element and iron, wherein said at least one compound is dispersed in said matrix.

* * * * *